United States Patent [19]

Woo et al.

[11] 3,951,780

[45] Apr. 20, 1976

[54] AROMATIC OILS BY THERMAL POLYMERIZATION OF REFINERY STREAMS

[75] Inventors: Charles Woo; Bruce M. Sankey, both of Sarnia, Canada

[73] Assignee: Exxon Research and Engineering Company, Linden, N.J.

[22] Filed: Oct. 25, 1974

[21] Appl. No.: 517,940

[52] U.S. Cl. ..... 208/14; 208/49; 208/71; 208/97; 208/144

[51] Int. Cl.[2] ..... C10G 37/08

[58] Field of Search ..... 208/67, 71, 14, 49

[56] References Cited

UNITED STATES PATENTS

| | | | |
|---|---|---|---|
| 3,324,029 | 6/1967 | King et al. | 208/14 |
| 3,496,095 | 2/1970 | Lewis | 208/67 |
| 3,654,135 | 4/1972 | Wegener et al. | 208/71 |
| 3,689,401 | 9/1972 | Gomi et al. | 208/57 |

*Primary Examiner*—Herbert Levine
*Attorney, Agent, or Firm*—Wayne Hoover

[57] ABSTRACT

A heat soaked polymer by-product from the production of gasoline using the 90°–400°F. steam cracker naphtha as feed is upgraded by first subjecting the same to a thermal polymerization and then subjecting the thermal polymerization product to a hydrotreating or hydrogenation step or both. Generally, the hydrotreatment is accomplished at relatively mild conditions so as to avoid any change in aromatic ring structure. Hydrogenation, on the other hand, is accomplished at more severe conditions so as to effect hydrogenation of the aromatic rings. In those cases where a mild hydrotreatment only is used, the products obtained are, generally, useful as aromatic oils of light color. Where more severe hydrogenation is used, on the other hand, the products are useful as naphthenic oils.

4 Claims, 1 Drawing Figure

AROMATIC OILS BY THERMAL POLYMERIZATION OF REFINERY STREAMS

BACKGROUND OF THE INVENTION

This invention relates to a method for upgrading certain refinery streams and to the product obtained thereby. More particularly, this invention relates to a method for preparing an aromatic or naphthenic oil from such streams.

As is well known, several refining operations such as cracking and coking lead, either directly or indirectly, to the production of product streams which are relatively high in both polyolefins and aromatics. This is, of course, particularly true in steam cracking operations wherein the production of olefin is a principal objective.

As is also well known, in steam cracking operations, a hydrocarbon feed is, generally, combined with steam so as to form a feed mixture containing between about 0.5 and 10 mole % steam. The hydrocarbon steam feed is then subjected to an elevated temperature, generally between the range from about 1300° to about 1700° F. at a pressure, generally between about 1 and 5 atmospheres and for a holding time, generally within the range from about 0.1 to about 3.0 seconds. The actual desired product or products as well as the by-product or by-products which are obtained will depend upon the particular hydrocarbon feed and the steam cracking conditions actually employed. In this regard, it should be noted that at one point in time it was most common to employ various naphtha cuts in steam crackers for the purpose of producing olefin. More recently, however, heavier residual fractions and entire crudes have been fed to steam crackers for the purpose of producing both olefin and gasoline. The naphthas produced via this route, however, contain significant amounts of unstable reactive olefins and various aromatics which must be removed before the steam cracker naphtha can be used in gasoline blending. These materials are, of course, easily separated in a heat soaking operation which results in a mild, thermal polymerization of the polymerizable olefins and the polymerizable aromatics as well as some condensation to form aromatic rings. The product thus obtained is, commonly, referred to as a heat soaked polymer and has heretofore had a very limited utility.

Heat soaking so as to cause a mild, thermal polymerization of polymerizable olefins as well as polymerizable aromatics and condensation thereof as a means of upgrading various refinery by-product streams as well as a means for separating unstable compounds is, of course, well known in the prior art. For example, in copending application Ser. No. 422,096 which was filed Dec. 5, 1973 a new and novel process for upgrading at least a portion of a refinery stream is disclosed and claimed. In this process, a two-stage synthesis is implied and, again, the process stream which is treated was derived from a mild steam cracking operation for the production of linear alpha olefins.

Notwithstanding the general use of heat soaking operations, hydrogenation and hydrofining in the upgrading of refinery streams containing a relatively high concentration of alpha olefins and polymerizable aromatics, particularly those derived from steam crackers operated for the production of olefins, it has not, heretofore, been believed possible to upgrade similar streams obtained in steam cracking operations designed for the production of gasoline. In this regard, and as noted, supra, it has been known in the prior art to employ a heat soaking operation so as to separate unstable olefins and polymerizable aromatics from steam cracked naphthas. It is also known, for example, in U.S. Pat. No. 3,689,401 that by-product heavy fraction formed during the production of normally gaseous olefins in a thermal cracker is up-graded by hydrotreating and hydrorefining steps followed by further alkylation with alpha olefins obtained from other sources. Upgrading via these techniques is, however, generally considered too expensive and the cost thereof generally exceed the values of the upgraded products. As a result, it is not, at this time, considered expedient to employ such methods in the upgrading of by-product streams. As also indicated, supra, it is known that the product obtained from the heat soaking operation could be further modified and used as a core oil. The demand for oils of this type is, however, quite limited and, as a result, only a portion of these materials is used for that purpose. As a result, a large majority of the heat soaked polymer has in the past, been fed to catalytic crackers or similar refining operations for further processing. Generally, however, maximum advantage is not achieved by such further processing. In light of this, then, the need for an improved process for upgrading such by-products is believed to be readily apparent.

SUMMARY OF THE INVENTION

It has now been surprisingly discovered that, the foregoing and other disadvantages associated with the prior art operations can be avoided with the process of this invention and an upgraded product obtained therewith. It is, therefore, an object of this invention to provide an improved process for upgrading a heat soaked polymer obtained in the production of a steam cracker naphtha useful in gasoline blending. It is another object of this invention to provide such a process which will enable the heat soaked polymer to be at least partially converted to lubricating oils of either aromatic or naphthenic character or a mixture of both. It is still another object of this invention to provide aromatic and/or naphthenic oils produced with such a process. These and other objects and advantages will become apparent from the disclosure set forth hereinafter and the figure appended thereto.

In accordance with the present invention, the foregoing and other objects and advantages are accomplished by first subjecting the heat soaked polymer to a thermal polymerization operation under conditions such that a product in the lubricating oil boiling range is obtained and then subjecting this product to a mild hydrotreating step when an aromatic oil is desired and a more severe hydrogenating step when a naphthenic oil is desired. It will, of course, be appreciated that the product obtained from the heat soaking operation could be fractionated to yield a product for further treatment boiling within any desired portion of the total range. It will also be appreciated that all or any portion of the initial product could be subjected to either one or both of the hydrotreating and hydrogenating steps so as to obtain one or more products of any desired characteristics. Moreover, it will be appreciated that any one or more of the separate products could be blended so as to obtain still different products having desired specifications.

DESCRIPTION OF THE FIGURE

The FIGURE is a schematic flow diagram of a process within the scope of the present invention.

DETAILED DESCRIPTION OF THE INVENTION

Figure 1:
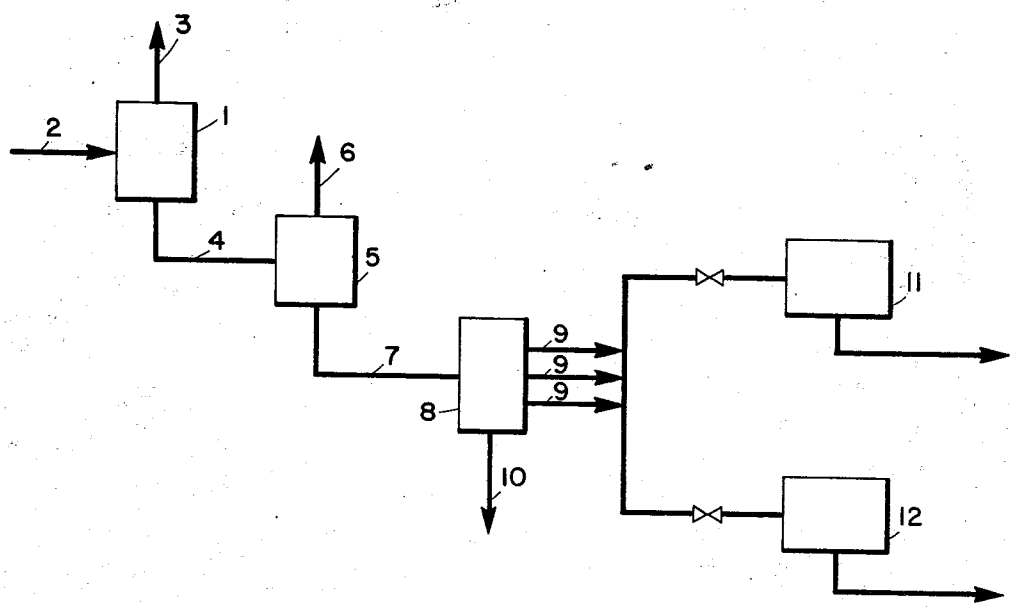

As previously indicated, the present invention relates to a method for upgrading a material obtained by heat soaking a steam cracker naphtha and to the products obtained therewith. As also indicated, supra, the steam cracker naphtha will be useful in gasoline blending after the heat soaking treatment.

In general, the steam cracker naphtha can be obtained by subjecting any of the heavier hydrocarbon fractions derived from a crude oil, including residual oil, to a steam cracking operation. Such feeds include, but are not necessarily limited to materials such as light naphtha, heavy naphtha, and gas oil, atmospheric resid, vacuum resid and essentially any of the crude oils known to be useful for this purpose.

In general, the steam cracked naphtha will be obtained by first combining one or more of the aforementioned feedstocks with steam such that the hydrocarbon steam mixture comprises between about 0.1 and 10 mole % steam. The hydrocarbon steam mixture will then be contacted in a suitable reactor at a temperature within the range from about 1300° to about 1700° F. for a period of time between about 0.1 and 3.0 seconds. Generally, the steam cracker will be operated at a pressure within the range from about 1 to about 5 atmospheres. Following the steam cracking, the hydrocarbon products will be obtained by suitable separating means such as fractionation, distillation or the like.

In general, the steam cracker naphthas from which the heat soaked polymer treated by the method of this invention is obtained, will boil within the range from about 80° to about 400° F. and the same will comprise saturates, olefins and aromatics containing from about 5 to about 12 carbon atoms therein. Generally, these olefins will be mainly linear and cyclic monoolelfins, conjugated and unconjugated diolefins, and polyolefins. Some of these olefins having the double bond in the alpha position may be present. Olefins having only one internal unsaturation may also be present in the steam cracker naphtha but these, generally, will not be further polymerized under the conditions of this invention. Moreover, the steam cracker naphtha from which the heat soaked polymer which is treated in accordance with this invention is produced, will have an aromatic carbon content between about 5 and 30 wt. % containing between about 5 and 12 carbon atoms and as indicated, previously, a portion of these aromatics will be polymerizable while another portion will either be condensable or condensed. These aromatics have unsaturated side chains and include, but are not necessarily limited to the styrene, divinyl benzene, vinyl naphthalene and their derivatives.

At this point, it should be noted that the preparation of a steam cracker naphtha which would be useful in the preparation of gasoline is well known in the prior art and the same forms no part of the present invention, except to the extent that the same is the source of the by-product treated in accordance therewith. Similarly, the separation of unstable materials from such a steam cracker naphtha with a heat soaking operation is also well known in the prior art and the same forms no part of the present invention except to the extent that particular conditions therefore are required so as to produce a heat soaked polymer particularly useful to the method of the present invention.

Notwithstanding the foregoing, it should be noted that the heat soaked polymer will be separated by subjecting a steam cracker naphtha to a temperature within the range from about 200° to about 400° F. for a period of time ranging between about 30 and 150 minutes. Generally, the heating will be accomplished under conditions such that the same is accomplished at autogenous pressure; i.e., the equilibrium of pressure of the naphtha at the particular temperature used. Higher pressures are, however, operable and, indeed such pressures can be achieved in accordance with known techniques. When used, however, such pressure will generally range between about 1 and 50 atmospheres.

Following the heat soaking operations, the heat soaked polymer may be separated from the steam cracker naphtha by any suitable means known in the art such as flashing, fractionation, distillation or the like. Generally, the heat soaked polymer thus obtained which are useful in the method of this invention, will boil within the range from about 200° to about 600° F. and comprise polymerized linear and cyclic polyolefin, polymerized aromatic, copolymerized polyolefin and polymerizable aromatic and condensed aromatics.

Once obtained, the heat soaked polymer which are useful in the method of the present invention may first be subjected to a further fractionation to obtain any desired portion thereof or the same may be, simply, treated so as to remove any light ends and then subjected to a thermal polymerization so as to obtain a product boiling, generally, within the lubricating oil range; viz., of about 600° to about 950° F. It will, of course, be appreciated that the exact boiling range will depend upon the boiling range of the initial material subjected to the thermal polymerization as well as to the conditions and time used during the thermal polymerization step. In this regard, it should be noted that the thermal polymerization will, generally, be accomplished at a temperature within the range from about 400° to about 700° F. or a holding time between about 30 and 150 minutes. Again, this thermal polymerization will be accomplished in substantially the same manner as heretofore described with respect to the heat soaking of the steam cracker naphtha. Particularly, the thermal polymerization will, generally, be accomplished at an autogenous pressure; i.e., the equilibrium pressure of the heat soaked polymer subjected to thermal polymerization throughout the reaction such as would be accomplished in an autoclave or the same may be accomplished at any pressure above the equilibrium pressure of the heat soaked polymer as the same is being polymerized in any of the several manners which would be apparent to those skilled in the art.

Following the thermal polymerization step, the polymerized product may, again, be subjected to fractionation so as to obtain any particular portion thereof for subsequent treatment, the same may be divided in substantially the same manner into several fractions for subsequent treatment via different routes or the same may be, simply, treated so as to separate both light and heavy fractions boiling outside the desired range. In any case, the portion or portions selected for subsequent treatment will then be either hydrotreated or hydrogenated.

In any case, the hydrotreating will, generally, be accomplished in accordance with techniques well known in the prior art and under conditions such that both the polymerized materials and the polycondensed aromatics will be hydrotreated without any change in ring structure. The oil obtained from this treatment would qualify as an aromatic oil.

Notwithstanding the fact that the techniques and conditions required for such hydrotreating are well known in the art, it should be noted that the hydrotreating step will generally be accomplished at a temperature within the range from about 300° to about 700° F. and with one or more of the catalysts known to be useful for this purpose. Such catalysts include sulfides of tungsten and molybdenum, nickel and molybdenum, and cobalt and molybdenum. It should also be noted that such treatment will, generally, be effected with a hydrogen partial pressure within the range from about 20 to about 70 atmospheres. Generally, the hydrotreating will be accomplished with a holding time within the range from about 0.25 to about 3.0 hours.

In those cases where it is desired to hydrogenate both the unsaturation in the polymerized chains or side chains as well as any other unsaturation in the condensed aromatic rings, more severe conditions will, generally be employed. In this regard, it should be noted that such hydrogenation could be accomplished either without the aforedescribed hydrotreatment or thereafter. There is, however, little, if any, advantage to hydrogenating after hydrotreating. For this reason, then, the hydrogenation will, generally, be accomplished in a single step and, generally, at a temperature within the range from about 600° to about 800° F. and hydrogen partial pressure within the range from about 70 to 150 atmospheres in the presence of a catalyst exhibiting activity for such hydrogenation. Catalyst of this type include metals and mixtures of metals such as molybdenum, nickel, palladium, platinum and the like.

The aromatic oils of this invention which are obtained by first thermal polymerizing a heat soaked polymer or a selected fraction or fractions thereof may be used as blending stocks, rubber extender oils, compressor oils, rubber seal swell additives, heat transfer media and electrical insulating agents. Moreover, these oils may be subject to further treatment such as extraction to produce a spectrum of products ranging from mixed to pure aromatic oils. Similarly, the naphthenic oils obtained by first thermal polymerizing a heat soaked polymer or a selected fraction or fractions thereof may be used in adhesives, binding, floor tiles, waterproofing and as electrical insulating oils. Moreover, the naphthenic oil, like the aromatic oils, may be subjected to further processing, such as extraction so as to produce a spectrum of additional products ranging from naphthenic blends to pure naphthenic oils. In any case, however, both the aromatic and naphthenic oils obtained according to this invention will exhibit extremely low viscosity indices, excellent thermal stability and excellent filler.

Having thus broadly described the present invention it is believed that the same will become even more readily apparent by reference to the appended Figure.

Turning then to the Figure, there is illustrated a schematic flow diagram of a process within the scope of the present invention. As illustrated in the Figure, the steam cracked naphtha or a fraction thereof, generally boiling within the range from about 80° to about 400° F. is fed to a suitable vessel 1 through line 2 and subjected to heat soaking at a temperature within the range between about 200° and about 400° F. for a period of time within the range from about 30 to about 150 minutes. As indicated previously, the heat soaking may be accomplished in any suitable vessel such as an autoclave. During the heat soaking, the unstable materials such as the diolefins, polyolefins and polymerizable and condensable aromatics are thermally polymerized to a higher molecular weight such that the same may be easily separated from the naphtha by flashing, distillation or similar means of separation. Following the heat soaking operation, the steam cracked naphtha is flashed overhead through line 3 and may be withdrawn therefrom for use in gasoline blending. The heat soaked polymer, on the other hand, which is produced as a result of the heat soaking is withdrawn through line 4 and then subjected to further thermal polymerization in a suitable vessel such as a reactor 5. Generally, the thermal polymerization in this step will be accomplished at a higher temperature than the heat soaking in the previous step. In this regard, it should be noted that the thermal polymerization will, generally be accomplished at a temperature in the range from about 400° to about 700° F. for a period of time ranging between about 30 and 150 minutes. Following the thermal polymerization, the polymerized heat soaked polymer may be withdrawn through line 7. At this point, the polymerized material may be fractionated so as to separate the low boiling and high boiling, undesirable components as well as to separate the same into any desired combination of fractions. Generally, any suitable means may be used to accomplish this separation, however, vacuum or atmospheric distillation in a fractionation column 8 is most convenient. As illustrated in the Figure, the low boiling materials may be distilled overhead through line 6, the desired fraction or fractions are withdrawn from the distillation column through a plurality of lines 9—9 while the high boiling bottoms fraction is withdrawn through line 10. The desired fractions, then, may be combined in any desired manner or treated separately so as to obtain either an aromatic or naphthenic oil. In this regard, and when an aromatic oil is desired one or more of the desired fractions will be transferred to a hydrotreating unit 11 and mildly hydrogenated in a manner heretofore described. When a naphthenic oil, on the other hand, is desired one or more of the desired fractions will be transferred to hydrogenator 12 and subjected to more severe hydrogenation conditions so as to hydrogenate any unsaturation in the polycondensed aromatic rings.

As previously indicated, and in those cases where it is desired to produce both an aromatic and a naphthenic oil, a portion of the desired thermally polymerized heat soaked polymer may be fed continuously to the hydrotreater while the remaining portion may be fed to the hydrogenator. Alternatively, the entire thermally polymerized product may be fed to either the hydrotreater or hydrogenator sequentially.

In general, and when the entire desired fraction of the thermally polymerized heat soaked polymer is treated in accordance with this invention, the aromatic and/or naphthenic oils will be obtained in a yield ranging between about 25 and 40 wt. % based on an initial feed to the thermal polymerizer 5. The remaining materials would be sent to other refining operations for further processing. In any case, both the aromatic and naphthenic oil will, generally, exhibit a viscosity within the range from about 50 to about 500,000 SUS at 100° F. and between about 30 and 1,000 SUS at 210° F. Both oils will also exhibit a viscosity index (V.I.) between about +40 and about −2000, the same will have pour points within the range from about −50° to +70° F. and the same will contain from about 3 to about 95 wt. % aromatics, by silica gel analysis. Moreover, both oils will exhibit colors ranging from about 0 to about +27 on the Saybolt scale and have a specific gravity within the range from about 4 to about 26 °API at 60° F.

PREFERRED EMBODIMENT

In a preferred embodiment of the present invention, a steam cracker naphtha having an initial boiling point within the range from about 80° to about 100° F. and a final boiling point within the range from about 300° to about 400° F. and containing between about 5 and 30 wt. % aromatic carbons and between about 15 and 40 weight % olefins will be heat soaked at a temperature within the range from about 200° to about 400° F. for a period of time within the range from about 30 to about 150 minutes so as to produce a heat soaked polymer containing between about 20 and 40 wt. % aromatic carbons comprising from about 6 to about 18 carbon atoms and from about 1 to about 3 condensed naphthene rings. This heat soaked polymer will then be subjected to a thermal treatment so as to produce a thermally polymerized oil product having an initial boiling point within the range from about 500° to about 650° F. and a final boiling point within the range from about 900° to about 1050° F. The thermally polymerized oil product will then be hydrotreated or hydrogenated at a temperature within the range from about 300° to about 800° F. in the presence of a suitable catalyst using a hydrogen partial pressure within the range from about 25 to about 150 atmospheres. In the preferred embodiment, the entire heat soaked polymer product will be subjected to thermal polymerization and the entire thermally polymerized product boiling within the range from about 500° to about 1050° F. will be subjected to the hydrotreatment. The product thus obtained will be used either as aromatic and/or naphthenic oils.

Having thus broadly described and illustrated the present invention it is believed that the same will become even more apparent by reference to the following examples which are included for purposes of illustrating particularly preferred embodiments and which are in no way intended to limit the present invention.

EXAMPLE 1

In this example, a heat soaked polymer by-product from the production of gasoline may be the 90°–400° F. steam cracked naphtha and having an initial boiling point of about 300° F. and a final boiling point of about 558° F. was subjected, in a batch operation to thermal polymerization at a temperature of about 650° F. for a period of about 60 minutes. Following the thermal polymerization, the thermal polymerized product was fractionated so as to separate both the high and low boiling materials and an oil having an initial boiling point of about 650° F. and a final boiling point of 950° F. in a yield of 26 wt. % based on total heat soaked polymer. The 650°–950° product, thus obtained, was then subjected to a hydrotreatment at a temperature of 500° F. in the presence of a cobalt molybdenum catalyst in a hydrogen partial pressure of 53 atmospheres at a space velocity of 1.0 V/V/hr. The hydrotreated product was then fractionated so as to obtain a first aromatic oil having a boiling range from 650° to 750° F., a second aromatic oil having a boiling range from 750° to 850° F. and a third aromatic oil having a boiling range from 850° to 950° F. The properties of each of these oils are summarized in the Table below.

TABLE I

| | Hydrotreated | | | Hydrogenated | |
|---|---|---|---|---|---|
| Boiling Range, °F. | 650–750 | 750–850 | 850–950 | 570–700 | 700–800 |
| Yield, wt. % on heat soaked polymer | 8.3 | 8.9 | 9.0 | 12.0 | 8.0 |
| Viscosity at 100°F., SUS | 130 | 3310 | — | 65.3 | 388 |
| Viscosity at 210°F., SUS | 38 | 67 | 422 | 35.0 | 46.7 |
| VI | −114 | −548 | — | 3.6 | −67.5 |
| Pour Point, °F. | −35 | 40 | 70 | −50 | 5 |
| Gravity, °API | 15.2 | 5.1 | 6.3 | 20.7 | 16.3 |
| RI at 20°C. | 1.5255 | 1.5860 | — | 1.4987 | 1.5142 |
| Aniline Point, °F. | 99 | 7 | 86 | 145 | 150 |
| Silica-Gel Separation, wt. % | | | | | |
| Saturates | 36.5 | 3.8 | 13.8 | 89.3 | — |
| Aromatics | 51.2 | 80.3 | 63.7 | 3.7 | — |
| Polars | 7.0 | 11.6 | 12.5 | 0.7 | — |
| Color Hold at 212°F. | | | | | |
| Initial | 20¼TR | 16¾TR | 18 TR | +19 Say | — |
| 16 hours | 20¼ | 16½ | 18 | +15 | — |
| 48 hours | 19½ | 15¾ | 17¾ | +9 | — |
| 168 hours | 19 | 13½ | 15½ | +2 | — |
| Thermal Stability 600°F. for 6 hrs. change in viscosity at 210°F., % | — | — | — | +1.0 | — |
| Electrical properties at 72°F. | | | | | |
| Dielectric constant | — | — | — | 2.54 | — |
| Dissipation Factor | — | — | — | 0.0000 | — |
| Volume Resistivity, ohm $cm^{-1}$ | — | — | — | $3.12\times10^{15}$ | — |

As will be readily apparent from the Table, the oils produced in this example have high aromatic content, particularly the oil having a boiling range from 750° to 850° F., all have extremely low V.I.s and each exhibits excellent, stable color. In each, the saturate fractions are almost entirely one to six ring naphthenes. The aromatic fractions contain substantial amounts of alkyl benzene, indene and tetralin. As will be readily apparent from these inspections, the aromatic oils thus obtained may be used as blending stocks, rubber extender oils, compressor oils, rubber seal swell additives, heat transfer media and electrical insulating agents.

The 650°–950° F. product was also subjected to more severe hydrogenating conditions at a temperature of 600° F. in the presence of a nickel catalyst in a hydrogen partial pressure of 100 atmospheres at a space velocity of 1.0 V/V/Hr. The hydrogenated product was then fractionated so as to obtain a first naphthenic oil having a boiling range from 570° to 700° F. and a second naphthenic oil having a boiling range from 700° to 800° F. The properties of these oils are also summarized in Table 1.

As will be apparent from the Table, the oils produced in this manner have high saturates content, higher V.I. and better color than the aromatic oils. The saturates fraction consists almost entirely of one to six ring naphthenes and the aromatics content is reduced to only about 4%. As will be readily apparent from these inspections, the naphthenic oils thus obtained may be used in adhesives, floor tiles, binding, water-proofing and as electrical insulating oils, etc.

While the present invention has been described by reference to particularly preferred embodiments thereof and by reference to a particular feedstock useful therein, it will be appreciated that the same lends itself to variations and modifications which would be obvious to those skilled in the art. For example, other feeds meeting the specifications herein set forth with respect to the heat soaked polymer could be used to produce the aromatic and naphthenic oils of this invention. Also, while not particularly preferred with respect to gasoline production, the thermal polymerized oil could be obtained by subjecting a steam cracker naphtha to a single thermal polymerization although the same would, necessarily, be accomplished at a higher temperature than that used in the heat soaking step described in this invention. Nonetheless, it is within the scope of this invention to accomplish the thermal polymerization in a single step. For these reasons, then, reference should be made solely to the appended claims to determine the scope of the present invention.

Having thus described and illustrated the present invention what is claimed is:

1. A method for producing a low V.I. aromatic oil of good color comprising the steps of:

a. heat soaking a steam cracker naphtha stream, useful in gasoline blending and having an initial boiling point within the range from about 80° to about 100° F. and a final boiling point within the range from about 300° to about 400° F., at a temperature within the range from about 200° to about 400° F. for a period of time within the range from about 30 to about 150 minutes at a pressure at least equal to the autogenous pressure of the steam cracked naphtha so as to produce a heat soaked polymer having an initial boiling point in the range from about 200° to about 400° F. and a final boiling point within the range from about 500° to about 650° F.;

b. separating the heat soaked polymer from said steam cracked naphtha and subjecting the same to a thermal polymerization at a temperature within the range from about 400° to about 700° F. for a period of time within the range from about 30 to about 150 minutes at a pressure at least equal to the autogenous pressure of the heat soaked polymer at the conditions of the thermal polymerization;

c. fractionating the thermally polymerized product so as to obtain at least one cut therefrom boiling within the range from about 650°–950° F.; and d. hydrotreating at least one cut boiling within the range from about 650° to about 950° F. at a temperature within the range from about 400° to about 700° F. in the presence of a hydrotreating catalyst and a hydrogen partial pressure within the range from about 25 to about 70 atmospheres.

2. A method for producing a naphthenic oil comprising the steps of:

a. heat soaking a steam cracker naphtha stream, useful in gasoline blending and having an initial boiling point within the range from about 80° to about 100° F. and a final boiling point within the range from about 300° to about 400° F., at a temperature within the range from about 200° to about 400° F. for a period of time within the range from about 30 to about 150 minutes at a pressure at least equal to the autogenous pressure of the steam cracked naphtha so as to produce a heat soaked polymer having an initial boiling point in the range from about 200° to about 400° F. and a final boiling point within the range from about 500° to about 650° F.;

b. separating the heat soaked polymer from said steam cracked naphtha and subjecting the same to a thermal polymerization at a temperature within the range from about 400° to about 700° F. for a period of time within the range from about 30 to about 150 minutes at a pressure at least equal to the autogenous pressure of the heat soaked polymer at the conditions of the thermal polymerization;

c. fractionating the thermally polymerized product so as to obtain at least one cut therefrom boiling within the range from about 650°–950° F.; and d. hydrogenating at least one cut boiling within the range from about 650° to about 950° F. at a temperature within the range from about 500° to about 800° F. in the presence of a hydrotreating catalyst and a hydrogen partial pressure within the range from about 70 to about 150 atmospheres.

3. An aromatic oil produced by the method of claim 1 exhibiting a viscosity within the range from about 50 to about 5000 SUS at 100° F. and between about 30 and 1000 SUS at 210° F., a viscosity index between about +40 and about −2000, a pour point within the range from about −50° to +70° F., said aromatic oil containing from about 3 to about 95 wt. % aromatics (by silica gel analysis) and exhibiting a color within the range from about 0 to about +27 (Saybolt) and a specific gravity within the range from about 4 to about 26 API at 60° F.

4. A naphthenic oil obtained by the method of claim 2 exhibiting a viscosity within the range from about 50 to about 5000 SUS at 100° F. and between about 30 and 1000 SUS at 210° F., a viscosity index between about +40 and about −2000, a pour point within the range from about −50° to +70° F., said aromatic oil containing from about 3 to about 95 wt. % aromatics (by silica gel analysis) and exhibiting a color within the range from about 0 to about +27 (Saybolt) and a specific gravity within the range from about 4 to about 26 API at 60° F.

* * * * *